United States Patent [19]

Noguchi

[11] 4,124,043

[45] Nov. 7, 1978

[54] METHOD AND APPARATUS FOR BOTTLING

[75] Inventor: Sadao Noguchi, Nagoya, Japan

[73] Assignee: Mitsubishi Jukogyo Kabushiki Kaisha, Tokyo, Japan

[21] Appl. No.: 801,019

[22] Filed: May 26, 1977

[30] Foreign Application Priority Data

May 28, 1976 [JP] Japan ..... 51-61090

[51] Int. Cl.[2] ..... B65B 3/18

[52] U.S. Cl. ..... 141/6; 141/39

[58] Field of Search ..... 141/37–66, 141/4–8

[56] References Cited

U.S. PATENT DOCUMENTS

| | | | |
|---|---|---|---|
| 2,514,072 | 7/1950 | Kantor | 141/57 |
| 2,783,785 | 3/1957 | Day et al. | 141/57 |
| 3,090,408 | 5/1963 | Naecker | 141/57 |
| 3,209,794 | 10/1965 | Granier | 141/57 |

*Primary Examiner*—Houston S. Bell, Jr.
*Attorney, Agent, or Firm*—Wenderoth, Lind & Ponack

[57] ABSTRACT

A counter-pressure type bottling valve assembly includes a vent tube and valve stem that are movably supported independently of the movable valve member of the main bottling valve and that can be displaced vertically by means of a pneumatic cylinder adapted to be driven by the counter-pressure gas. The movable valve member of the main bottling valve, operable from outside of the valve assembly between its closed and opened positions. Snifting means is provided for snifting the counter-pressure gas confined in the space delimited by the main bottling valve, a lower portion of a main body of the valve assembly, and a bottle neck portion sealing coupled to the bottom of the main body of the valve assembly. The vent tube is replaceably connected to the valve stem for varying the length of the vent tube to fill a bottle.

12 Claims, 13 Drawing Figures

METHOD AND APPARATUS FOR BOTTLING

BACKGROUND OF THE INVENTION

The present invention relates to improvements in a method and an apparatus for bottling by making use of a counter-pressure gas in a tank, that is a so-called "filler-bowl," for storing the liquid to be bottled.

Counter-pressure type bottling valve assemblies and methods for operating the same have been heretofore known and widely used in practice. Now in order to highlight the disadvantages of such prior art apparatuses and methods, by way of example, a specific structure of the bottling valve assembly and a method for operating the same in accordance with the prior art will be described in detail with reference to FIGS. 1 through 6 of the accompanying drawings.

In FIGS. 1 and 2, an outer valve actuating lever 1 and an inner valve actuating lever 3 integrally connected to the former via a shaft 2 are rotatably mounted on a side wall of a filler-bowl 4 (not shown except for a cross-section of its bottom wall, but to be described in detail later in connection with FIGS. 7 to 9). It is to be noted that in FIG. 1 the outer valve actuating lever 1 is shown by a solid line in the closed position thereof designated by *a*, and also shown partly by a dot-dash line in the opened position designated by *b*. Reference numeral 5 generally designates a charging valve member consisting of an upper valve body 5*a*, a lower valve body 5*b* and a packing 6 sandwiched therebetween, the lower valve body 5*b* is in a freely slidable relation with respect to a stem 7, and a spring 8 is compressed between the stem 7 and the lower valve body 5*b*, whereby the charging valve member 5 is supported through the spring 8 as floating above the stem 7. Reference numeral 5*c* designates a vent hole, and a pneumatic valve is formed by charging valve member 5, packing 6 and stem 7. On the stem 7 is fixedly secured a collar 9, which is upwardly biased by a spring 10 in a spring case 11. At the bottom of the stem 7, an annular packing 12 is fixedly contained in an annular groove, and a subject liquid valve is formed by the packing 12 and a snift block 13. The snift block 13 includes a snift valve consisting of a cap nut 14, a snift stem 15, a packing 16 and a spring 17, as well as a snift orifice 18. Under the snift block 13 are provided an outer centering cup 19 and an inner centering cup 20, and these members are mounted to the filler-bowl 4 via a packing 22 by means of a metal mounting piece 21. In addition, to the bottom of the stem 7 is screwed a vent tube 23, a spreader 24 is mounted on the vent tube 23, and a vent hole 25 is drilled in a side wall of the vent tube 23 beneath the spreader 24. Reference numeral 26 designates an empty bottle to be filled with the subject liquid. The bottle neck is pressed against the inner centering cup 20 so as to eliminate any leakage between the neck of the bottle and the inner centering cup 20 by pushing up the empty bottle 26 from its bottom side by means of a pneumatic cylinder 27. Reference numeral 11*a* designates liquid passageways formed in spring case 11. FIG. 2 shows the same bottling valve assembly in a different state where the outer valve actuating lever 1 and the inner valve actuating lever 3 are shown as displaced to the position *b*, that is, in a bottling state where the subject liquid valve and the pneumatic valve are both opened, with the vent tube 23 and the stem 7 raised by a dimension equal to *c* while the charging valve 5 is raised by a dimension equal to *d* with respect to the state shown in FIG. 1. Dimensions *c* and *d* are established such that $c<d$. It is to be noted that the above-referred stroke *c* of the valve stem 7 is defined by the limiting effect that an upper edge of a radial stopper fin 7*b* fixedly secured to a radially expanded bottom portion 7*a* of the valve stem 7 strikes against a downward inner shoulder portion of the spring case 11, while the above-referred stroke *d* of the charging valve 5 is defined by the linear stroke of the inner valve actuating lever 3.

Now the bottling process in the prior art will be described with reference to FIGS. 1 through 6. At first, when the bottle 26 has been raised by means of the pneumatic cylinder 27, the state shown in FIG. 1 is established, but in this state the subject liquid has not been filled into the bottle. In the state shown in FIG. 1, if the outer valve actuating lever 1 and the inner valve actuating lever 3 are displaced from the position *a* to the position *b*, then the charging valve 5 is raised, and only the valve 5 takes the position shown in FIG. 2. Subsequently, the pressurized gas at a predetermined counter pressure (normally at 2–4 $kg/cm^2$-G) within the filler-bowl 4 flows in directions opposite to the arrows 28, 29 and 30, so that the inner pressure of the bottle 26 is also raised to the same pressure as that maintained within the filler-bowl 4. Consequently, the spring 10 compressed between the collar 9 and an upward inner shoulder portion of the spring case 11 pushes up the valve stem 7 and the vent tube 23 via the collar 9 until the upper edge of the radial stopper fin 7*b* strikes against the downward inner shoulder portion of the spring case 11, and thereby the state shown in FIG. 2 is established. Then the subject liquid flows into the bottle 26 along the path represented by arrows 31, 32, 33, 34, 35 and 36, while the gas in the bottle 26 is returned to the filler-bowl 4 through the path represented by arrows 30, 29 and 28, and in this way the bottling operation proceeds. Subsequently when the liquid surface 37 in the bottle 26 has risen up to the level where the vent hole 25 is blocked, the gas flow represented by the arrow 30 is interrupted. At this moment, the flow of the subject liquid represented by arrow 33 is also interrupted at the top end portion of the snift block 13 but the subject liquid then flowing through the portions represented by the arrows 34 and 35 will fall into the bottle 26, and the liquid surface within the bottle 26 eventually takes the level shown at 38 in FIG. 1. At the same time, the subject liquid also enters the inner hollow space of the valve stem 7 and the space is filled with the subject liquid up to the level shown at 39. Here, if the outer valve actuating lever 1 and the inner valve actuating lever 3 in FIG. 1 are returned to the position *a*, then the state shown in FIG. 1, that is, the state where the subject liquid valve and the pneumatic valve have been both closed after bottling, can be established. At this time, in the upper hollow section 40 of the valve stem 7 and in the upper empty section 41 of the bottle 26 there is maintained the counter-pressure. Then, if the snift stem 15 is pushed in the direction of arrow 42, the snift valve is opened, so that the counter-pressure in the sections 40 and 41 is released to the atmosphere as choked by the snift orifice 18. In other words, owing to the snifting operation, the pressure in the sections 40 and 41 gradually returns to the atmospheric pressure. Nextly, the bottle 26 is removed from the bottling valve assembly by lowering the pneumatic cylinder 27.

In the heretofore known bottling valve assembly, the above-described bottling process is repeated, and in such case the following disadvantages occur. That is, in the above-described process, when the gas confined in the section 40 is released through the vent hole 25, since the gas passes through the liquid within the bottle 26 in the form of bubbles as shown in FIG. 3, separation of carbonic acid gas dissolved in the subject liquid from the subject liquid is promoted by the snift shock, so that there occurs the disadvantage that the bubbles of the separated carbonic acid gas overflow during the step of removing the bottle 26 from the bottling valve assembly as shown in FIG. 4.

In addition, upon bottling fruit juice or the like (normally bottled as heated at about 90° C. and carbonic acid gas not being contained in the subject liquid) it is necessary to set the surface of the liquid contents just after bottling at such level that the dimension *h* in FIG. 6 is kept at about 5 mm, but this is impossible because of the snifting operation for the counter-pressure gas in the section 40. More particularly, if the surface of the liquid contents is set so that the dimension *h* is about 5 mm, then due to the falling of the liquid along the inner surface of the bottle and falling of the liquid in the section of the valve stem 7 up to the level 39 upon snifting, the liquid surface level would be raised above the top surface of the neck of the bottle, so that at the moment when the inner centering cup 20 and the neck of the bottle have been separated from each other, the liquid would overflow out of the bottle. This makes normal bottling impossible, and therefore, the above-describe prior art bottling valve assembly cannot be used for fruit juice. It has commonly been impossible to use the same bottling valve assembly both for soft drinks containing carbonic acid gas and fruit juice drinks without carbonic acid gas.

Furthermore, in the heretofore known bottling valve assembly shown in FIG. 1, the minimum value for the dimension *h* representing the level of the surface of the contents in FIG. 6 was 15–20 mm. The reasons are as follows. That is, because of the falling of the liquid flowing through the sections represented by the arrows 34 and 35 in FIG. 2 into the bottle during the step where the liquid level 37 within the bottle rises and eventually blocks the vent hole 25, as well as the falling of the subject liquid within the valve stem 7 from the level 39 in FIG. 1 into the bottle 26 during the step of opening the snift valve by pushing the snift stem 15, the highest possible level of the liquid surface within the bottle after completion of the above-mentioned steps could be nearly at the liquid level 43 shown in FIG. 5. (If the liquid level 43 is raised higher than the spreader 24, then when the bottle 26 is lowered in the next step, then some of the subject liquid would be pulled or scraped up by the spreader 24, so that overflow of the liquid would occur. In other words, the state where in-flow of the liquid from the bottling valve assembly into the bottle has been interrupted, is considered to be the state where the pressure in the head space within the bottle is balanced with the head pressure of the falling liquid. Accordingly, when the liquid level in the bottle rises up to the vent hole 25, and thereby the release path for the gas within the bottle has been blocked, the pressure within the bottle rises and pushes the liquid nearly up to the level 39 where the gas pressure within the bottle is balanced with the liquid head pressure of the liquid column under the level 39. It is to be noted that when this state is established the liquid having been flowing along the inner bottle wall has already fallen into the bottle. Thereafter, when the head space of the bottle neck is snifted by closing both the pneumatic valve and the liquid valve, the head space of the bottle neck is released to the atmospheric pressure, naturally the compressed gas confined between the liquid level 39 and the upper valve body 5a is also released to the atmospheric pressure, so that the liquid within the stem 7 under the level 39 falls into the bottle, and thus forms the highest liquid level 43 in FIG. 5. Subsequently, when the bottle has been lowered relative to the bottling valve assembly, the liquid level 38 is lowered by the depth corresponding to the volume of the vent tube 23, and after all, the dimension *h* for the highest liquid level as defined in FIG. 6 falls to within the range of $h = 15$–$20$ mm.

SUMMARY OF THE INVENTION

The object of the present invention is to obviate the above-described prior art disadvantages, to provide a novel method of bottling and a novel bottling valve assembly to be used for practicing the method, which make stable bottling without snift shock possible, and which are applicable in common both to drinks containing and not containing carbonic acid gas.

According to one feature of the present invention there is provided a method for bottling wherein after a subject liquid valve has been closed, wherein a bottle neck is sealingly pressed against a bottling valve assembly a vent tube fits in a main body of the bottling valve assembly, and subsequently, after the vent tube has been removed to a position above the liquid surface in the bottle, a snifting operation is carried out.

According to another feature of the present invention there is provided a bottling valve assembly of the counter-pressure type associated with a device for raising and lowering a vent tube. Upon feeding an empty bottle to the valve assembly, the vent tube is held at an upwardly raised position by means of a pneumatic cylinder which makes use of a counter-pressure in a filler-bowl. After the empty bottle has been fed to the bottling valve assembly the vent tube is lowered to a bottling position by the resilient force of a spring within a cylinder chamber of the pneumatic cylinder by releasing the counter-pressure in the pneumatic cylinder to carry out a bottling operation. After completion of the bottling operation and after a subject liquid valve has been blocked, the vent tube is drawn up by introducing the counter-pressure into the pneumatic cylinder, and after the vent tube has been raised above the surface in the bottle, a snifting operation is carried out.

BRIEF DESCRIPTION OF THE DRAWINGS

The above-mentioned and other features and objects of this invention will become more apparent by reference to the following description taken in conjunction with the accompanying drawings, in which.

DETAILED DESCRIPTION OF THE INVENTION

Figure 7:
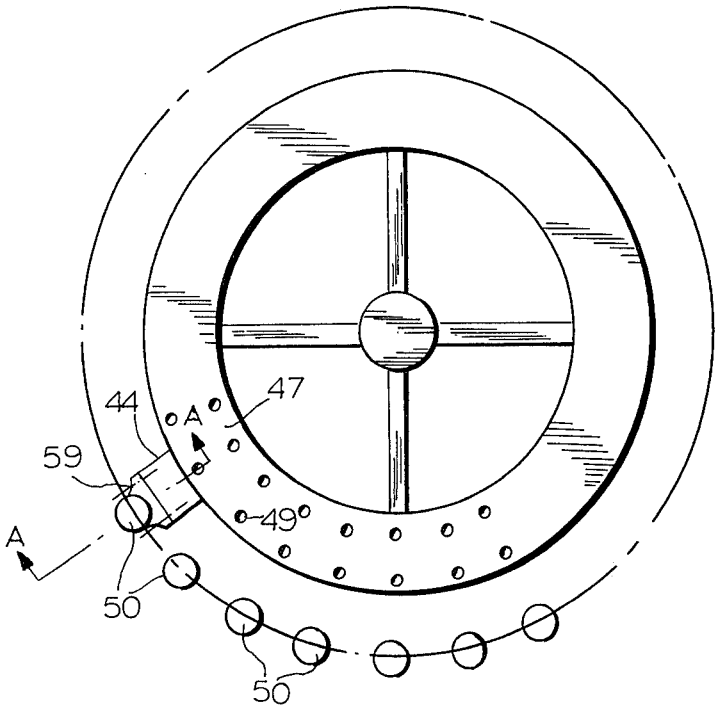
FIG. 7 is a schematic plan view of a bottling machine employing bottling valve assemblies according to one preferred embodiment of the present invention.
Figure 8:
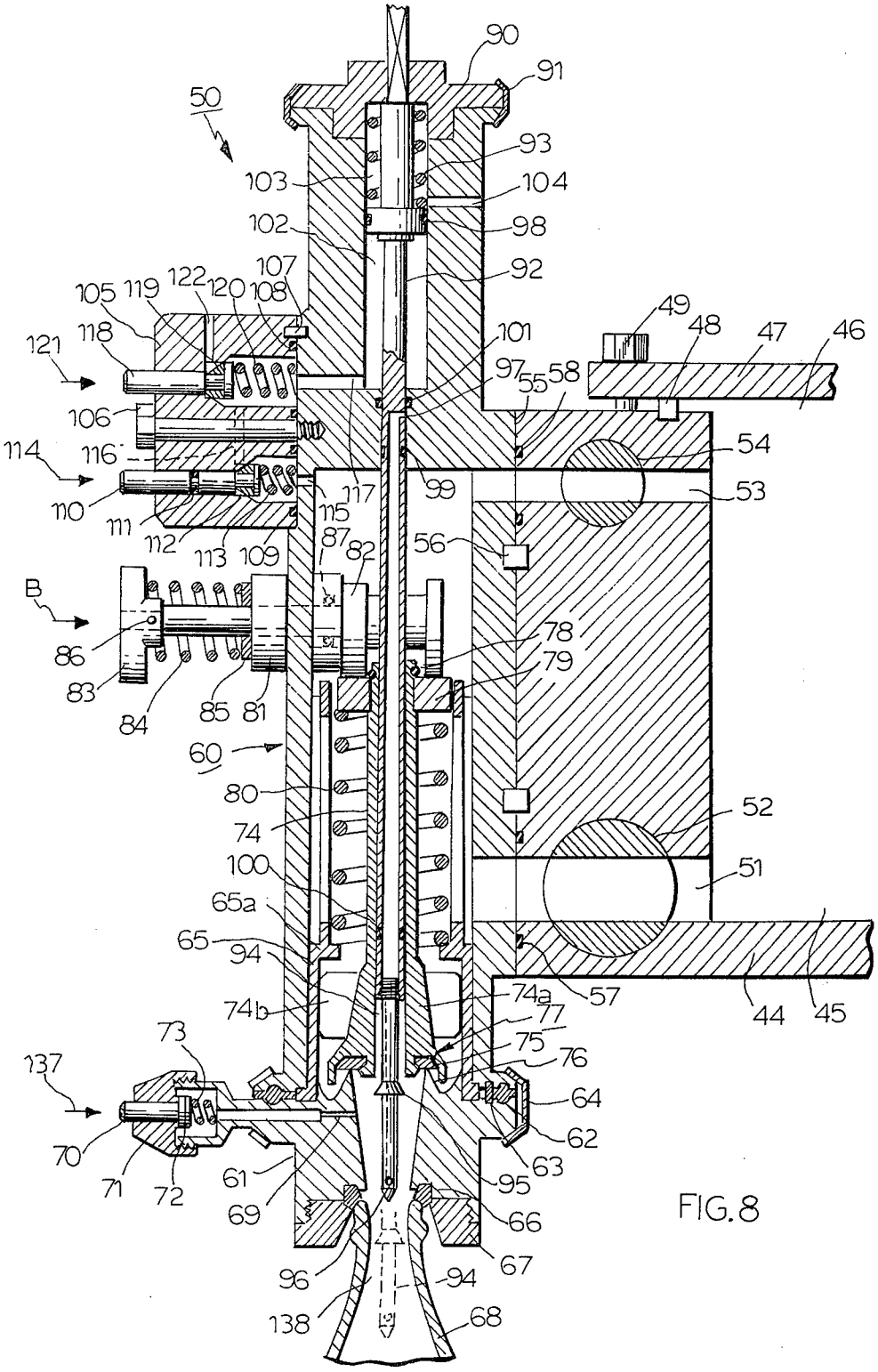
FIG. 8 is a vertical cross-section view taken along line A—A in FIG. 7 as viewed in the direction of arrows.

Referring now to the drawings, a bottling machine employing bottling valve assemblies according to one preferred embodiment of the present invention is shown in plan in FIG. 7, and an enlarged cross-section taken along line A—A in FIG. 7 of the same bottling valve assembly is illustrated in FIG. 8. In these figures, a filler-bowl 44 is a pressure vessel, in which subject liquid 45 is filled up to a predetermined surface level as controlled by a known control device, and in the space above the predetermined surface level is charged a counter-pressure gas 46, such as air air or carbonic acid gas). To the filler-bowl 44 is fastened a filler-bowl cover 47 via a packing 48 by means of bolts 49 to sealingly close the filler-bowl 44 for forming a leakless structure. In addition, along the outer circumference of the filler-bowl 44 are disposed a plurality of bottling valve assemblies 50 as shown in FIG. 7. In FIG. 8, the filler-bowl 44 is individually provided with a liquid communication port 51 having a liquid cock 52 and communicating with the bottling valve assembly 50, and a counter-pressure gas communication port 53 having a gas cock 54 and communicating with the bottling valve assembly 50, for each bottling valve assembly 50. The bottling valve assembly 50 is mounted on a valve mounting surface 55 of the filler-bowl 44 via anti-leakage O-rings 57 and 58 by means of bolts 59 (FIG. 7), as positioned by means of positioning pins 56.

Figure 10:
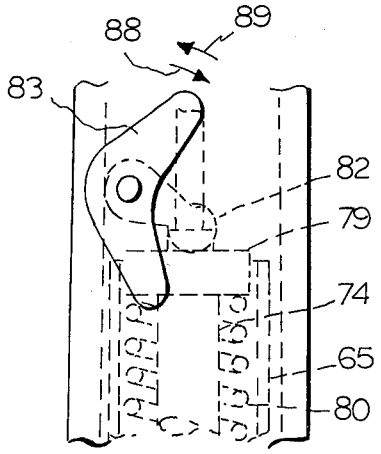
FIG. 10 is a partial side view of the bottling valve assembly in FIG. 8 as viewed in the direction of arrow B in FIG. 8.
Figure 9:
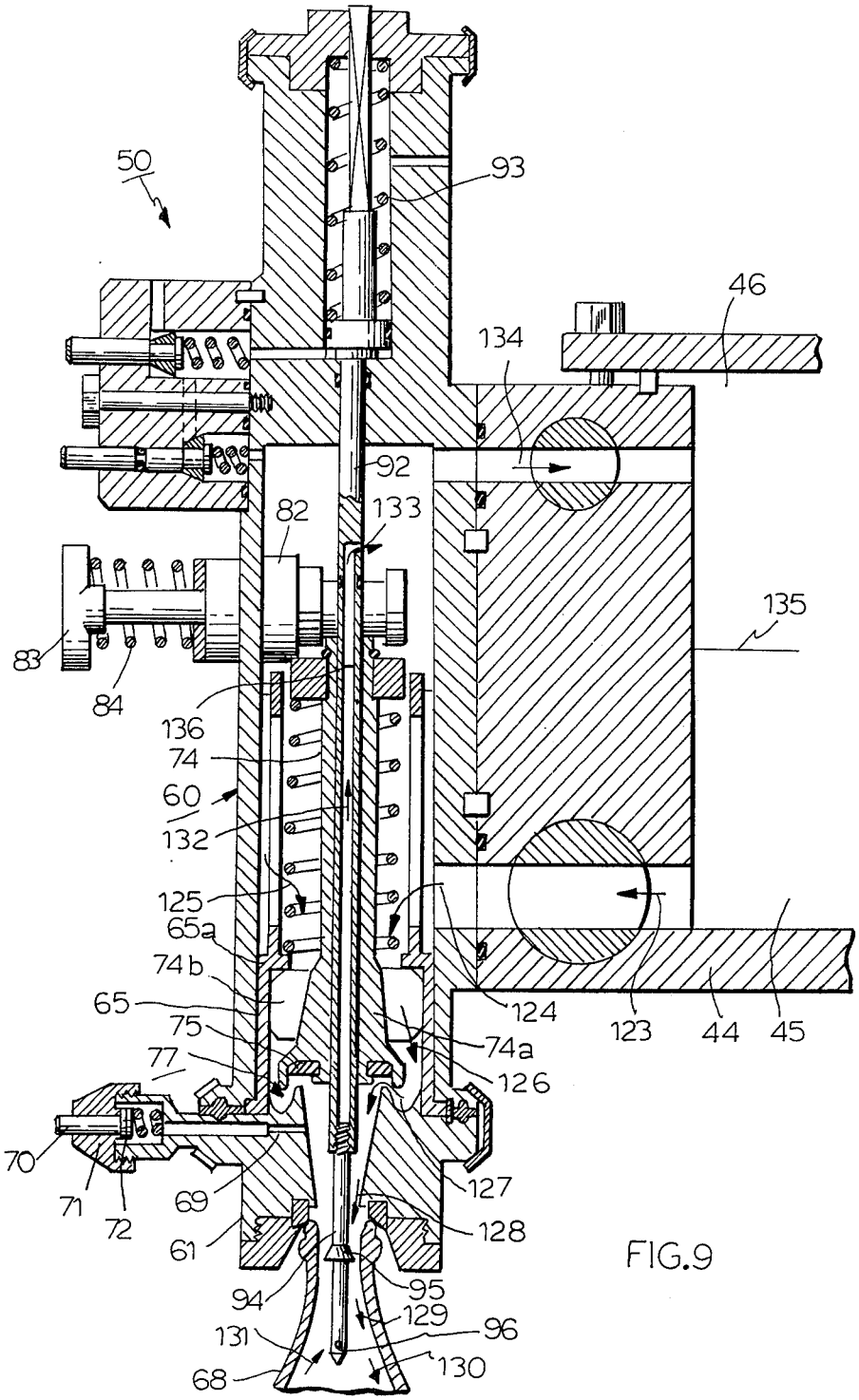
FIG. 9 is another vertical cross-section view similar to FIG. 7 but in a different operating state.

With regard to the structure of the bottling valve assembly 50, such valve assembly is constructed mainly of a valve body 60, and to the bottom of the valve body 60 is fixedly secured a snift block 61 via a packing 62 and positioning pins 63 by means of a clamp 64. At the same time, a spring case 65 is fixed within the valve body 60, and to the bottom of the snift block 61 is fixedly secured a packing 66 for sealing a neck of a bottle by means of a mouth piece 67. Upon bottling, an empty bottle 68 is centered by the mouth piece 67 and sealed with the bottle neck seal packing 66. In addition, on the left side of the snift block 61 is provided a snift orifice 69, and further a snift stem 70 is assembled by means of a cap nut 71 in such manner that the snift stem 70 can slide in the left and right directions. To the snift stem 70 is nounted a packing 72 which serves to seal the snift system from the atmosphere by operating jointly with a spring 73. Inside the spring case 65 is supported a valve stem 74 in a vertically slidable manner, at the bottom of the valve stem 74 is mounted a packing 75, and a liquid valve 77 is formed by packing 75 and an annular protrusion 76 at the top of the snift block 61. A plurality of radial stopper fins **74*b* are fixedly secured to a radially expanded bottom portion 74*a* of the valve stem 74, and fins 74*b* serve to limit the upward stroke of the valve stem 74 when the upper edges of fins 74*b* strike against a downward inner shoulder portion 65*a* of the spring case 65. The downward stroke of the valve stem 74 is limited by the engagement of the packing 75 at the bottom of the stem 74 with the annular protrusion 76 on the snift block 61. The valve stem 74 is always subjected to an upward biasing force by a spring 80 within the spring case 65 via a collar 79 fixedly secured to the stem 74 by means of a snap ring 78. At the center of the valve body 60 is provided a lever mechanism for opening and closing the liquid valve 77. In addition, on the valve body 60 is provided a boss 81, to which an inner valve lever 82 and an outer valve lever 83 forming the lever mechanism are mounted via a spring 84 and a friction plate 85. A pin 86 fixes the inner valve lever 82 and the outer valve lever 83 and leakage is prevented by means of an O-ring 87. FIG. 10 is a partial side view as seen in the direction of the arrow B in FIG. 8, and as represented in this figure, the outer valve lever 83 is adapted to be rotated in the directions represented by arrows 88 and 89 from the outside in response to the operation of a mechanism not shown. The state where the lever 83 has been actuated in the direction of the arrow 88 is shown in FIG. 8, whereas the state where it has been actuated in the direction of the arrow 89 is shown in FIG. 9. It is to be noted that in the state shown in FIG. 10, the liquid valve 77 is kept closed. At the top of the valve body 60 is fixedly secured a top cover 90 by means of a clamp 91, and within a cylinder delimited by the valve body 60 and the top cover 90 are provided a piston formed by an extension of a vent stem 92 and a spring 93 adapted to push the vent stem 92 downwardly. The vent stem 92 extends downwardly and is slidably supported in a center bore of the valve stem 74, and to the bottom end of the vent stem 92 is screw-connected a vent tube 94. On the vent tube 94 is provided a spreader 95. The bottom end of the vent tube 94 is closed, and a vent hole 96 is drilled in a side wall of the vent tube 94 in the proximity of its bottom end. The vent hole 96 communicates through the vent tube 94 and the inner bore of the vent stem 92 with a vent hole 97 which is drilled in a side wall of the vent stem 92 at the top end of the inner bore. The vent stem 92 is provided with O-rings 98, 99 and 100 for sealing in grooves formed on its outer circumference, while another O-ring 101 for sealing the vent stem 92 is provided in a groove formed on an inner circumference of a bore in the valve body 60. The vent stem 92 is supported by the bore in the valve body 60 in a vertically slidable manner, so that when a counter-pressure gas is introduced into a cylinder chamber 102, the vent stem 92 will slide upwardly while compressing the spring 93 and the vent tube 94 will also move to a higher position (the state shown in FIG. 8). However, for such an operation it is necessary to drill an exhaust port 104 in a wall of a spring chamber 103. The top section of the vent stem 92 which fits in a hole in the top cover 90 has a square-shaped cross-section to provide a structure for preventing rotation of the vent stem 92 upon screwing the vent tube 94 into the bottom of the vent stem 92**.

Reference numeral 105 designates a valve block for charging and discharging a counter-pressure gas into and from the cylinder chamber 102. Block 105 which is fixedly secured to the valve body 60 by means of a bolt 106 and a pin 107, and in order to seal the valve block, O-rings 108 and 109 are provided. Reference numeral 110 designates a charging valve which is slidably disposed in the valve block 105, which is associated with an O-ring 111 and a packing 112, and which normally seals the counter-pressure gas with the resilient force of a spring 113. If the charging valve 110 is pushed in the direction represented by an arrow 114 by actuating it with externally operable means (not shown), then a counter-pressure gas within the valve body 60 is fed to the cylinder chamber 102 through communication ports 115, 116 and 117 for the counter-pressure gas, so that the vent stem 92 will rise until the position shown in FIG. 8 is realized. Reference numeral 118 designates a discharging valve, which is slidably disposed in the valve block 105, which is associated with a packing 119, and which normally seals the counter-pressure gas with the resilient force of a spring 120. If the discharging valve 118 is pushed in the direction represented by an arrow 121 by actuating it externally with operating means not shown, then the counter pressure gas in the cylinder chamber 102 is discharged to the atmosphere through gas communication ports 117 and 122.

Explaining now the operation of the above-described bottling valve assembly, with reference to FIG. 8, the subject liquid 45 flows to the interior of the valve body 60 through the liquid communication port 51 and the liquid cock 52, while the counter-pressure gas 46 is also fed to the interior of the valve body 60 through the gas communication port 53 and the gas cock 54. In addition, in the final step of the bottling process, by actuating the charging valve 110 in the direction of the arrow 114, the counter-pressure gas 46 is also fed to the cylinder chamber 102 through the gas communication ports 115, 116 and 117. Then the bottle 68 in an empty state is fed from below, and the neck of the bottle is sealed by the seal packing 66 as shown in FIG. 8.

Describing the subsequent bottling steps in succession, when the outer valve lever 83 is driven in the direction of the arrow 89 in FIG. 10 by an external operation, the inner valve lever 82 also moves concurrently, and so, the inner valve lever 82 leaves from the collar 79. At the same time, if the discharging valve 118 is pushed in the direction of the arrow 112 by an external operation, then the counter-pressure gas in the cylinder chamber 102 is discharged to the atmosphere through the gas communication ports 117 and 122 and the vent stem 92 is lowered as urged by the spring 93, so that the vent tube 94 takes the position represented by the dashed line in FIG. 8. As a result, a vent hole 97 provided at the upper portion of the vent stem 92 communicates with the counter-pressure gas in the interior of the valve body 60. While the above-described operations of the pneumatic cylinder is effected by utilizing the carbonic acid gas within the filler-bowl 44, in the final step of operation the carbonic acid gas in the cylinder chamber 102 is discharged to the atmosphere. However, essentially the air contained in an empty bottle is returned to the filler-bowl during the bottling operation, and so, in order to maintain the pressure of the counter-pressure gas 45 within the filler-bowl 44 constant, the equivalent amount of carbonic acid gas is intentionally discharged to the atmosphere. More particularly, since the liquid level in the filler-bowl 44 is maintained at a fixed level by sensing the liquid level by means of a float (not shown) provided in the filler-bowl 44, it becomes necessary to regulate the counter-pressure in the fixed volume above the liquid level within the filler-bowl 44. During a normal operation, the volume of the air in the empty bottle being returned to the filler-bowl acts as a plus factor, the volume of the gas discharged to the atmosphere upon snifting acts as a minus factor, and since the plus factor is larger than the minus factor in volume, it is necessary to discharge the gas within the filler-bowl to the atmosphere. The above-mentioned intentional discharge of the carbonic acid gas in the cylinder chamber 102 is effected for such a purpose.

Then the counter-pressure gas 46 is passed from the vent hole 97 through the inner bores of the vent stem 92 and the vent tube 94 and discharged from the vent hole 96 into the empty bottle 68 to pressurize the interior of the bottle 68. When the pressure in the bottle 68 has been equalized to the pressure of the counter-pressure gas 46, the snap ring 78, collar 79, valve stem 74, packing 75 and radial stopper fins **74*b* are pushed up by the resilient force of the spring 80 until the upper edges of the radial stopper fins 74*b* strike against the downward inner shoulder portions 65*a* of the spring case 65. Then the liquid valve 77 is opened and the condition shown in FIG. 9 is established. In this position, the subject liquid 45 flows along the path represented by arrows 123, 124, 125, 126, 127, 128, 129 and 130 and enters into the bottle 68. At the same time, the counter-pressure gas within the bottle 68 flows along the path represented by arrows 131, 132, 133 and 134 and returns to the source of the counter-pressure gas 46**. Thus the bottling process proceeds.

Figure 11:
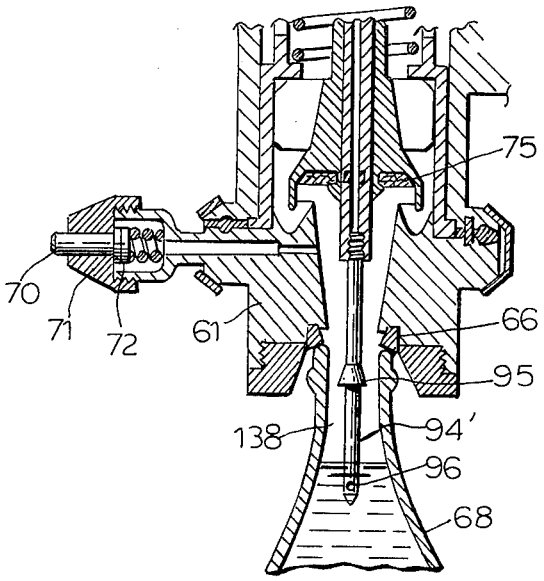
FIG. 11 is a partial cross-section view of the bottling valve assembly of FIG. 8 showing the state where the feeding of the subject liquid into the bottle has been interrupted.

Subsequently, the liquid level in the bottle 68 rises until the vent hole 96 is blocked by the liquid, and further the subject liquid enters into the inner bores of the vent tube 94 and vent stem 92. When the liquid level in the inner bores has reached the same level 136 as the liquid level 135 of the subject liquid 45 in the filler-bowl 44, the subject liquid then flowing through the path along the arrows 128 and 129 falls into the bottle in a manner similar to that of the prior art valve assembly, and the liquid flow stops at the state illustrated in FIG. 11. Nextly, if the outer valve lever 83 is driven in the direction of the arrow 88 in FIG. 10 by actuation from the outside of the valve body 60, then the inner valve lever 82 is also driven concurrently to push the collar 79, so that the collar 79, snap ring 78, valve stem 74, radial stopper fins **74*b* and packing 75 are jointly depressed, resulting in closure of the liquid valve 77. Here, if the charging valve 110 is pushed in the direction of the arrow 114 in FIG. 8 by actuation from the outside of the valve body 60, then the counter-pressure gas 46 enters into the cylinder chamber 102 through the gas communication ports 115, 116 and 117, and pushes up the vent stem 92 against the resilient force of the spring 93. The vent tube 94 and spreader 95 associated with the vent stem 92 are simultaneously pushed up and the conditions shown in FIG. 8 can be established. More particularly, upon pushing up the vent stem 92, the carbonic acid gas within the filler-bowl 44 is led to the cylinder chamber 102 by pressing the charging valve 110, and thereafter if the charging valve 110 is restored to its initial position, the cylinder chamber 102 is kept pressurized, and thereby the raised condition of the vent stem 92 can be maintained. On the other hand, upon lowering the vent stem 92, if the discharge valve 118 is pressed to release the pressure within the cylinder chamber 102 to the atmosphere, then the vent stem 92 can be lowered by the resilient force of the spring 93. Although some of the subject liquid is pulled up when the vent stem 92 and the vent tube 94 are drawn up, there occurs no problem because the neck of the bottle is kept sealed against the seal packing 66. It is to be noted that the mechanism for pressing the charging valve 110 is not specially difficult in design, and this operation is the same as the operation of pressing the snift button in a snifting stem in a known bottling valve assembly. More particularly, the bottling machines generally include rotary means in which bottles are continuously fed to and removed from the bottling valve assembly, and it is only necessary to press the charging valve 110 at an appropriate position prior to the snifting step, so that it is only required to provide a fixed actuating member for the charging valve 110** at an appropriate position along a circumference of the rotary means.

Nextly, if the snift stem 70 is pressed in the direction of the arrow 137 in FIG. 8 by actuation from the outside of the valve body 60, then the counter-pressure gas filled in the head space 138 of the bottle 68 and the counter-pressure gas confined within the inner bore of the vent stem 92 above the liquid level 136 in FIG. 9 are discharged through the snift orifice 69 and an opened gap space of the packing 72, so that the head space 138 is slowly reduced in pressure down to the atmospheric pressure. At this moment the bottling operation has been completed, and, the bottle is subsequently removed downwardly by means of a well-known device.

Figure 12:
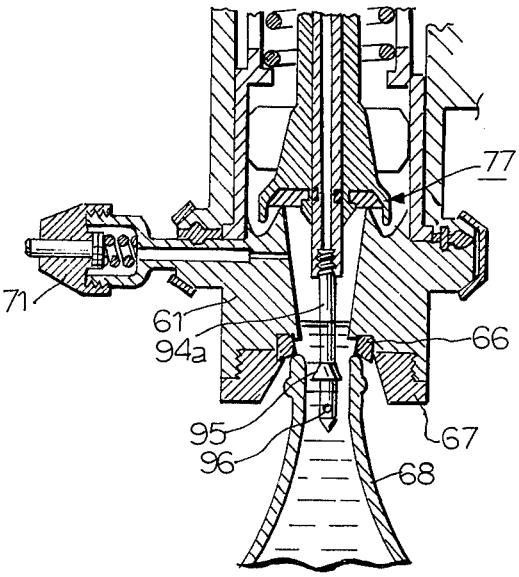
FIGS. 12 and 13 are partial cross-section views of another preferred embodiment of the present invention showing the states where the vent tube is lowered and raised, respectively.
Figure 13:
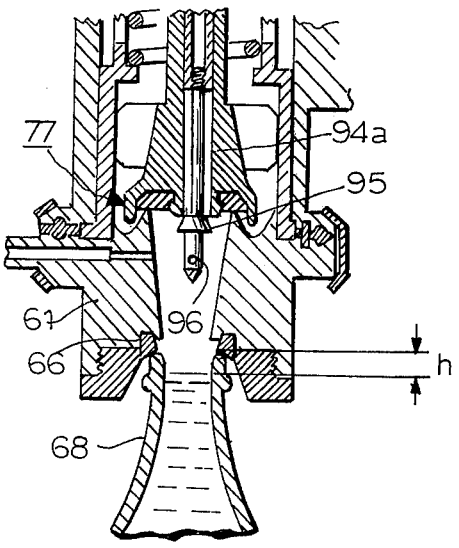

If the vent tube is formed shorter in length as shown at 94a in FIG. 12 so that the liquid surface within the bottle may come above the spreader 95 when the liquid valve 77 has been closed, then even upon bottling fruit juice (normally bottled while being heated up to 90° C. and carbonic acid gas being not contained in the subject liquid), the surface of the liquid contents just after the bottling operation can be positioned at about $h = 5$ mm as shown in FIG. 13 and yet the liquid never overflows. More particularly, if the vent tube is made shorter, as the vent tube 94a has been drawn up before the neck of the bottle leaves the seal packing 66, overflow of the liquid outside of the bottle would never occur.

Figure 1:
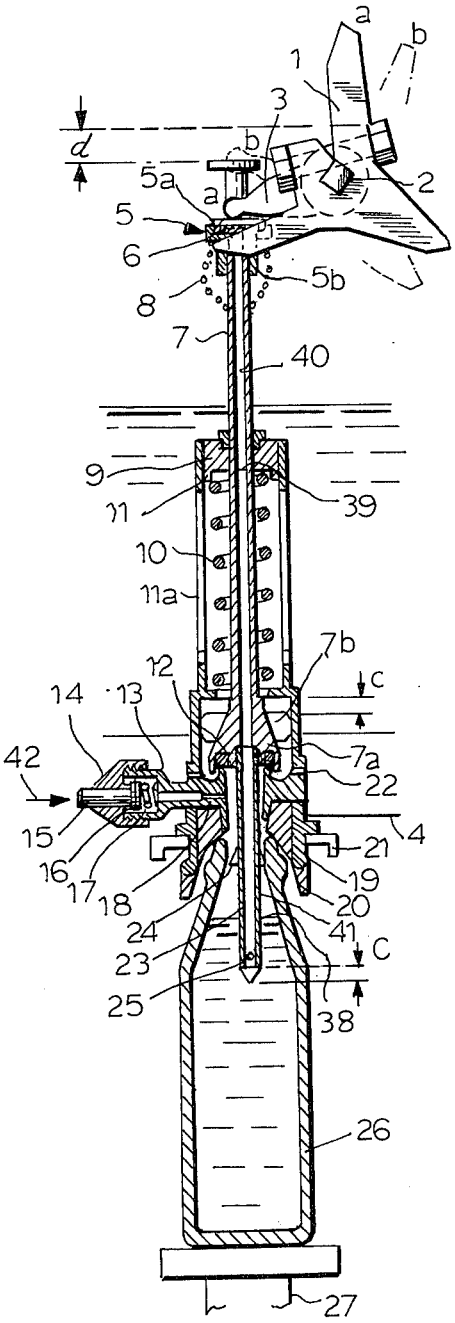
FIG. 1 is a longitudinal cross-section view showing one example of the counter-pressure type bottling valve assemblies known in the prior art.
Figure 2:
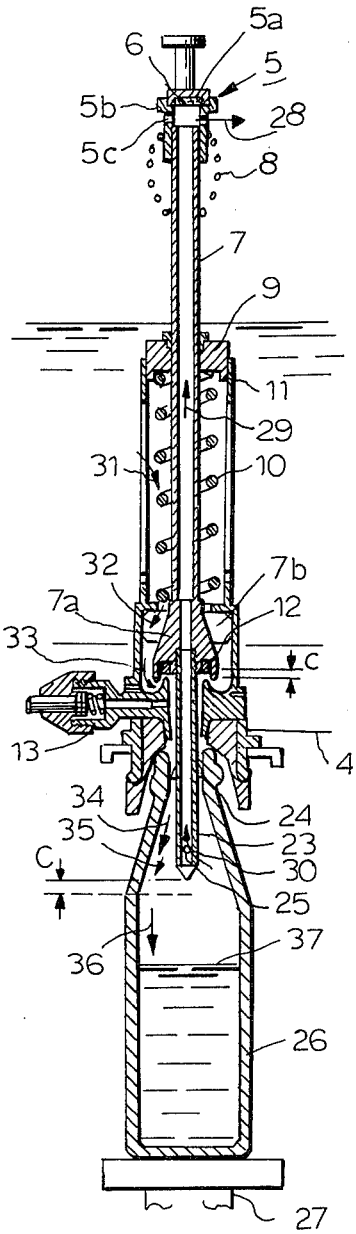
FIG. 2 is another longitudinal cross-section view of the same bottling valve assembly in a state where a vent tube has been raised from the position shown in FIG. 1, FIGS. 3 through 6 are schematic partial cross-section views explaining the bottling process by making use of the bottling valve assembly shown in FIGS. 1 and 2.
Figure 3:
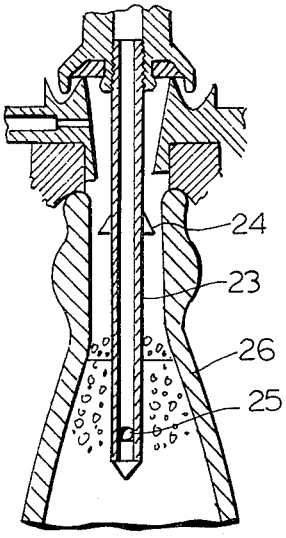
Figure 4:
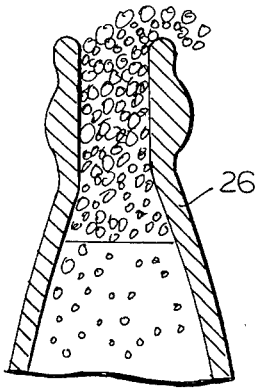
Figure 5:
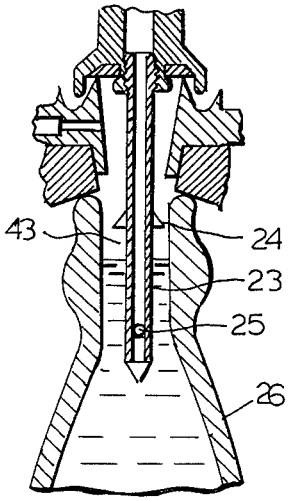
Figure 6:
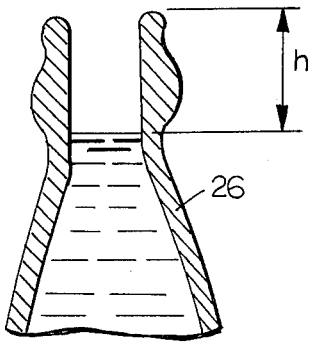

As fully described above, according to the present invention, since the vent tube is drawn up after the bottling operation has been completed and the subject liquid valve has been closed, and since the snifting operation is carried out after the vent tube has been raised above the liquid surface in the bottle, there is no in-flow of the liquid into the bottle upon raising the vent tube, thus resulting in stabilization of the surface of the liquid contents, and the counter-pressure gas would never pass through the liquid in the bottle in the form of bubbles as shown in FIG. 3, so that the adverse phenomena of promoting separation of carbonic acid gas dissolved in the subject gas from the subject gas will not occur. Therefore, according to the present invention, stable bottling operations free from variations of the level of the liquid contents and snift shocks can be achieved, and the method and apparatus according to the present invention can be effectively applied in common to bottling both of drinks containing and not containing carbonic acid gas. Further, it is to be noted that the bottling valve assembly according to the present invention is applicable to bottling machines, bottling-capping machines, etc.

Since many changes could be made in the above construction and many apparently widely different embodiments of this invention could be made without departing from the scope thereof, it is intended that all matter contained in the above description or shown in the accompanying drawings shall be interpreted as being illustrative only and not limiting.

What is claimed is:

1. A bottling process comprising:

providing a supply of liquid pressurized by a supply of gas;

providing a bottling valve assembly having therein a liquid valve;

sealingly pressing the neck of a bottle against said bottling valve assembly while said liquid valve is closed;

lowering a vent tube through said bottling valve assembly into said bottle so that a lower vent hole in the lower portion of said vent tube is located within said bottle, and so that an upper vent hole in the upper portion of said vent tube is placed in communication with said supply of gas, whereby said gas flows through said vent tube into said bottle;

opening said liquid valve and allowing liquid from said liquid supply to pass through said liquid valve into said bottle until the level of liquid in said bottle closes said lower vent hole in said vent tube;

then closing said liquid valve;

then raising said vent tube until said lower vent hole is above said liquid level in said bottle and said upper vent hole is isolated from said gas supply;

then exhausting to the exterior atmosphere a gas volume enclosed between said liquid level in said bottle, said bottling valve assembly, and said liquid valve; and thereafter removing the thus filled bottle from sealing contact with said bottling valve assembly.

2. A bottling system comprising:

a filler-bowl containing therein a liquid supply pressurized by a gas supply;

a bottling valve assembly having therein an interior communicating with both said liquid supply and said gas supply;

said bottling valve assembly having a lower open end selectively closable by a liquid valve to isolate said assembly interior;

sealing means on said lower end of said bottling valve assembly for sealingly contacting the neck of a bottle;

a tubular member having in a lower end thereof a lower vent hole and in an upper portion thereof an upper vent hole, said tubular member being mounted within said bottling valve assembly for vertical movement therethrough between a first raised position wherein said upper vent hole is isolated from said assembly interior and said lower vent hole is above a bottle sealed against said sealing means, and a second lower position whereat said upper vent hole is in communication with said assembly interior and said lower vent hole is positioned within a bottle sealed against said sealing means;

means for, after a bottle is sealed against said sealing means, lowering said tubular member from said first position thereof to said second position thereof, and for thereby allowing gas from said gas supply to pass through said tubular member into the bottle to pressurize the interior of the bottle;

means for opening said liquid valve and for allowing liquid from said liquid supply to pass therethrough into said bottle until the level of liquid in the bottle closes said lower vent hole in said tubular member;

means for closing said liquid valve;

means for raising said tubular member from said second position thereof to said first position thereof, such that said lower vent hole is above the liquid level in the bottle; and means for exhausting to the exterior atmosphere a gas volume enclosed between the liquid level in the bottle, said bottling valve assembly, and said closed liquid valve, whereafter the thus filled bottle may be removed from sealing contact with said sealing means.

3. A system as claimed in claim 2, further comprising a cylinder having therein a vertically movable piston, said piston being fixed to the upper end of said tubular member.

4. A system as claimed in claim 3, wherein said means for raising said tubular member comprises means for supplying gas from said gas supply into said cylinder at a position below said piston and for thereby raising said piston and said tubular member.

5. A system as claimed in claim 4, wherein said gas supplying means comprises a valve block attached to an upper portion of said bottling valve assembly, first passage means extending from said assembly interior into said cylinder, a charging valve slidably movable in said valve block, first spring means normally urging said charging valve into a position to close said first passage means, and said charging valve being movable against said first spring means to open said first passage means to thereby allow said gas to pass therethrough into said cylinder.

6. A system as claimed in claim 5, wherein said means for lowering said tubular member comprises second passage means extending from said cylinder to the exterior atmosphere, a discharging valve slidably movable in said valve block, second spring means normally urging said discharging valve into a position to close said second passage means, said discharging valve being movable against said second spring means to open said second passage means and to thereby allow gas within said cylinder to exhaust to the exterior atmosphere, and third spring means normally urging said piston downwardly in said cylinder and thereby said tubular member to said lower position thereof.

7. A system as claimed in claim 4, wherein said means for lowering said tubular member comprises means for exhausting gas within said cylinder to the exterior atmosphere, and a spring normally urging said piston downwardly in said cylinder and thereby said tubular member to said lower position thereof.

8. A system as claimed in claim 2, wherein said tubular member comprises a hollow vent stem having therein said upper vent hole and having an open lower end, and a replaceable hollow vent tube having an open upper end removably attached to said lower end of said vent stem, said vent tube having a closed lower end, said lower vent hole extending through a side wall of said vent tube at a position adjacent said closed lower end thereof, whereby the level of the liquid filled into the bottle may be changed by exchanging said vent tube with another vent tube of different length.

9. A system as claimed in claim 2, wherein said liquid valve comprises a valve seat formed integrally with said bottling valve assembly, and a valve member mounted within said bottling valve assembly for vertical movement between a first lower position in sealing contact with said valve seat and a second upper position spaced from said valve seat.

10. A system as claimed in claim 9, wherein said tubular member sealingly extends through said valve member.

11. A system as claimed in claim 9, wherein said means for opening said liquid valve comprises a spring biasing said valve member to said second upper position thereof.

12. A system as claimed in claim 11, wherein said means for closing said liquid valve comprises cam means, positioned within said bottling valve assembly and operable from exterior said bottling valve assembly, for displacing said valve member downwardly against the force of said spring into said first lower position.

* * * * *